US005730009A

United States Patent [19]

Westfield

[11] Patent Number: 5,730,009

[45] Date of Patent: Mar. 24, 1998

[54] CARRYING CASE WITH THEFT PREVENTION CLAMP

[76] Inventor: Mark Jason Westfield, 1210 N. Taft St., Apt. 201, Arlington, Va. 22201

[21] Appl. No.: 588,081

[22] Filed: Jan. 18, 1996

[51] Int. Cl.[6] ..... E05B 65/52

[52] U.S. Cl. ..... 70/63; 70/58; 70/67; 248/552; 190/101; 109/52

[58] Field of Search ..... 70/18, 19, 57, 70/58, 63, 67, 69; 109/50–52; 248/552, 551, 553; 211/4, 8, 9; 190/101, 102

[56] References Cited

U.S. PATENT DOCUMENTS

| | | | |
|---|---|---|---|
| D. 339,113 | 9/1993 | Kelly et al. . | |
| D. 344,074 | 2/1994 | Collins . | |
| D. 344,269 | 2/1994 | Toedter et al. . | |
| 345,302 | 7/1886 | Hayes et al. | 109/51 |
| 1,069,646 | 8/1913 | Richter | 70/49 |
| 2,708,989 | 5/1955 | Bogdanski | 70/58 |
| 3,858,531 | 1/1975 | Rubinstein | 109/52 |
| 3,934,434 | 1/1976 | Law | 70/63 |
| 4,066,195 | 1/1978 | Dickler | 70/58 |
| 4,474,116 | 10/1984 | Castenaoa, Jr. et al. | 70/63 |
| 4,738,341 | 4/1988 | Asano . | |
| 4,918,632 | 4/1990 | York . | |
| 5,052,651 | 10/1991 | Guddee . | |
| 5,144,821 | 9/1992 | Ernesti et al. | 70/14 |
| 5,160,001 | 11/1992 | Marceau . | |
| 5,214,574 | 5/1993 | Chang . | |
| 5,217,119 | 6/1993 | Hollingsworth . | |
| 5,260,884 | 11/1993 | Stern . | |
| 5,329,865 | 7/1994 | McWard | 109/50 |
| 5,359,550 | 10/1994 | Chen . | |
| 5,361,610 | 11/1994 | Sanders . | |
| 5,369,970 | 12/1994 | Voieulescu et al. | 70/49 |
| 5,445,266 | 8/1995 | Prete et al. . | |
| 5,595,074 | 1/1997 | Munro | 248/551 |

FOREIGN PATENT DOCUMENTS

| | | | |
|---|---|---|---|
| 992345 | 7/1976 | Canada | 70/19 |
| 508485 | 10/1920 | France . | |
| 1032266 | 6/1953 | France | 70/69 |
| 482574 | 7/1953 | Italy | 70/69 |
| 510493 | 8/1939 | United Kingdom . | |
| 659112 | 10/1951 | United Kingdom . | |

*Primary Examiner*—Darnell M. Boucher
*Attorney, Agent, or Firm*—Richard C. Litman

[57] ABSTRACT

The invention relates to a carrying case with a theft prevention clamp. It is especially designed for laptop computers left in public places, but may also be used to prevent other items from being stolen. The clamp is designed to removably fasten the carrying case to a table, but may also be used on shelves or other objects with similarly shaped surfaces. The clamp has a flexible portion and a rigid portion. The carrying case has an upper portion and a lower portion, which are pivotally connected. There is a lock for securing the upper portion to the lower portion when they are in a closed position. A keyhole switch activates a battery-powered electric motor to extend the clamp when a key is inserted, if the key is turned clockwise, or to retract the clamp, if the key is turned counterclockwise. Once the clamp is extended, it and the lower portion of the carrying case can be inserted around a table or other object with similar surfaces. The clamp is then retracted to fasten the carrying case to the table or other object.

6 Claims, 4 Drawing Sheets

CARRYING CASE WITH THEFT PREVENTION CLAMP

BACKGROUND OF THE INVENTION

1. Field of the Invention

The present invention relates to a carrying case, e.g. for a laptop computer, with a theft prevention clamp by which the carrying case, and thus the laptop computer, may be secured to a table or shelf.

2. Description of the Prior Art

Laptop computers (and other portable equipment) are frequently stolen when briefly left unattended in a public place, such as a library. There is a need for a means to temporarily secure such devices, without risk of damage to the equipment, or a table, shelf or other furniture to which it is attached, being increased by the means used to secure it. This need is not met in the prior art by a means equivalent to the present invention, which is a device by which a carrying case/laptop computer may be conveniently clamped to a table.

U.S. Pat. No. 4,738,341, issued on Apr. 19, 1988, to Tautomu Asano, discloses a lock system for a suitcase or container, with the container being fastened to an object, e.g., a table leg, by a wire looped around the object. It may be distinguished from the instant invention, by which the case is clamped to an object.

U.S. Pat. No. 4,918,632, issued on Apr. 17, 1990, to Dennis C. York, discloses a notebook mountable computer system, which reduces the probability of theft by hiding the computer in a notebook. U.S. Pat. No. 5,052,651, issued on Oct. 1, 1991, to Guddee, discloses a fastener for portable equipment, comprising a frame to hold the equipment, with the frame attached to a supporting surface by adhesive tape. This is distinguishable from the instant invention in that it may damage the table, the tape is not reusable, it does not have a carrying case, and it may not be effective in preventing the theft of lightweight portable equipment because it can simply be pulled off the table.

U.S. Pat. No. 5,160,001, issued on Nov. 3, 1992, to Stephen M. Marceau, discloses a computer carrying case, which is a combination briefcase and carrying case for transporting a personal computer and ancillary supplies.

U.S. Pat. No. 5,214,574, issued on May 25, 1993, to Bo E. Chang, discloses a portable computer housing in combination with a portable computer, by which the portable computer is protected from damage. It is distinguishable from the instant invention in that means for fastening a carrying case to a supporting surface or object to prevent theft are not included.

U.S. Pat. No. 5,217,119, issued on Jun. 8, 1993, to Dale Hollingsworth, discloses a carrying case for a laptop computer, including a cradle for the computer suspended by elastic support members to absorb shocks.

U.S. Pat. No. 5,260,884, issued on Nov. 9, 1993, to Jonathan Stern, discloses a brief case containing a computer as an integral part, with a removable keyboard, and space for carrying document, books, or other items.

U.S. Pat. No. 5,359,550, issued on Oct. 25, 1994, to Chin-Mao Chen, discloses a notebook computer system for cooperating with projectors, having a notebook computer pivotally connected with a liquid crystal display pivotally connected with a cover, and a bracket for supporting the computer on a side of the housing of a projector.

U.S. Pat. No. 5,361,610, issued on Nov. 8, 1994, to Richard Sanders, discloses a totelock, comprising a pair of plates that are inserted into the disk drive of a computer, locked together, and secured to a fixed object by a cable to prevent theft. The instant invention is distinguishable, in that the computer is in a carrying case secured to a fixed object by a clamp, and there is no risk of damage to the disk drive should someone try to steal the computer by pulling out the anti-theft device.

U.S. Pat. No. 5,445,266, issued on Aug. 29, 1995, to Richard Prete and Pablo V. Vialera, discloses a carrying case and variable-angle support stand for a portable computer, so that the computer can be positioned at an optimum viewing angle. The computer may be readily removed from the case for hand-held use. There is no means for securing the computer or carrying case to another object to prevent theft, as in the instant invention.

U.S. Pat. No. Des. 339,113, issued on Sep. 7, 1993, to Thomas J. Kelly, Henry J. Mack, Jr., David J. Mayer, and Stephen G. Miggels, discloses a design for a portable computer enclosure, which does not include a means for clamping it to a surface or object to prevent theft.

U.S. Pat. No. Des. 344,074, issued on Feb. 8, 1994, to Stevens M. Collins, discloses a design for a combination of a laptop computer with a cellular telephone and a carrying case.

U.S. Pat. No. Des. 344,269, issued on Feb. 15, 1994, to Peter K. Toedter, Kevin D. Simmons, and Charles S. Currun, discloses a design for computer housing.

French Patent No. 508.485, published Oct. 3, 1920, issued to Victor-Gabriel Pernet, discloses a system for carrying packages.

British Patent No. 510,493, specification accepted Aug. 2, 1939, issued to Fritz Otto Wöhler, discloses a combined suitcase and portfolio, but does not include a means for securing it to another object.

British Patent No. 659,112, complete specification published Oct. 17, 1951, issued to Brian William Finnigan and Finnigans Limited, discloses a despatch or brief case, but does not include a means for securing it to another object.

None of the above inventions and patents, taken either singly or in combination, is seen to describe the instant invention as claimed, i.e., a carrying case suitable for a laptop computer, with a means for clamping it to a table or other object with similar surfaces.

SUMMARY OF THE INVENTION

Accordingly, it is a principal object of the invention to provide a convenient means for preventing the theft of a laptop computer in a public place.

It is another object of the invention to provide a means for preventing the theft of any other article that will fit into the carrying case.

It is a further object of the invention to provide a means for preventing the theft of a laptop computer that will not cause damage to the computer or the disk drive of the computer, or a table, shelf or other furniture to which it is attached.

Still another object of the invention is to provide a theft prevention means that may be easily disengaged when not needed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention relates to a carrying case with a theft prevention clamp. It is especially designed to prevent the theft of laptop computers from public places, but may also be used to prevent the theft of other items.

Figure 1:
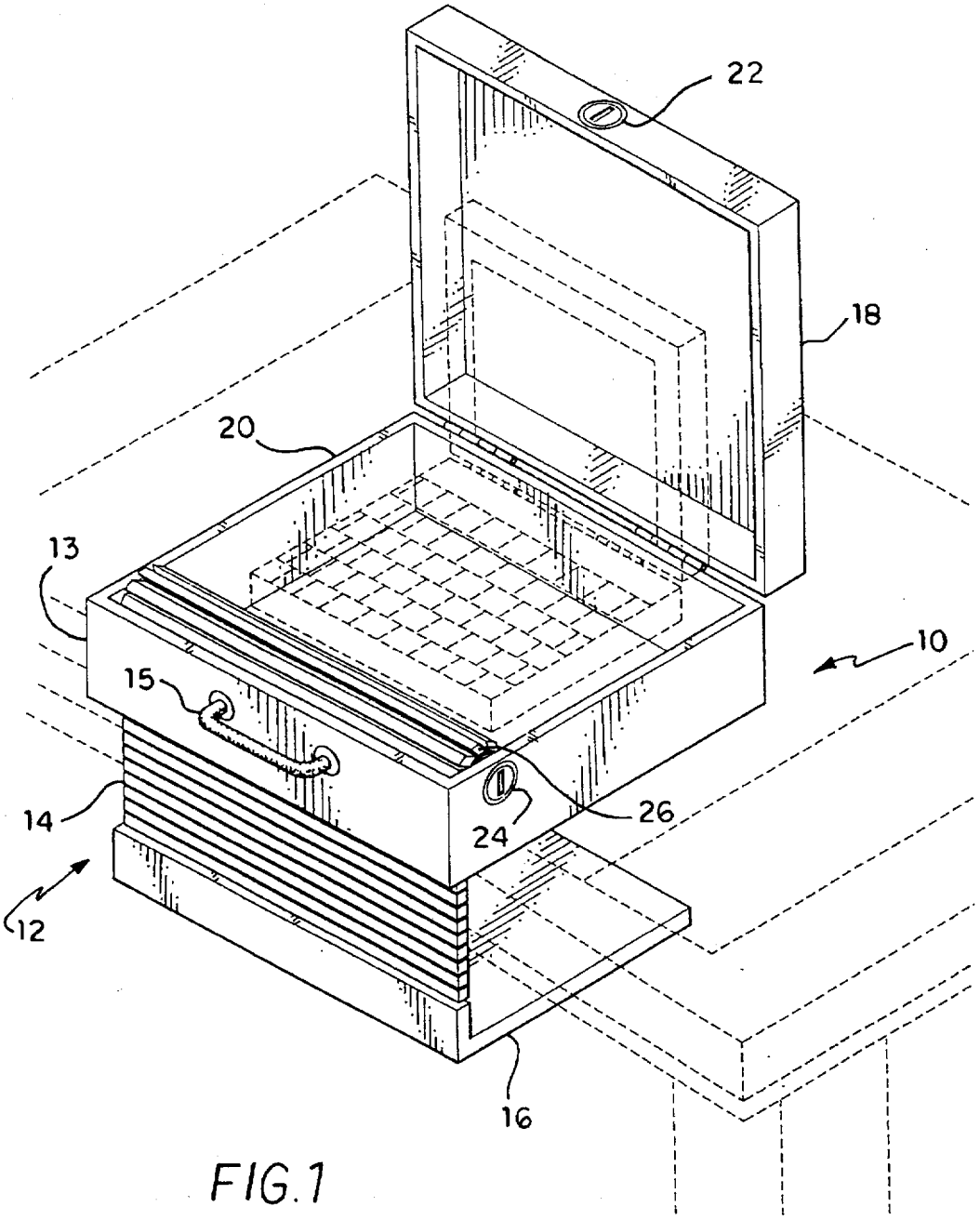
FIG. 1 is an environmental perspective view of the invention.

FIG. 1 shows the carrying case 10 with theft prevention clamp 12. Shown in broken lines are a laptop computer inside the carrying case, and a table to which the clamp is fastened, the computer and table not being part of the claimed invention per se. The clamp may have a flexible portion 14 and has a rigid portion 16. The carrying case has an upper portion 18 and a lower portion 20. The clamp extends from and retracts into the front side 13 of the lower portion of the carrying case. There is a handle 15 on the front side. The case is shown in an open position, but there is a lock 22 for securing the upper portion to the lower portion when they are in a closed position. Also shown is a keyhole switch 24, by which, when a key (not shown) is inserted, a battery-powered electric motor (not shown) in the lower portion of the case will be activated to extend the clamp if the key is turned clockwise, or to retract the clamp, if the key is turned counterclockwise, or visa versa. Alternatively, the arm may be raised and lowered by manual means (not shown). The clamp is shown in an extended position; when retracted, the flexible portion of the clamp is wound around the cylinder 26.

Figure 2:
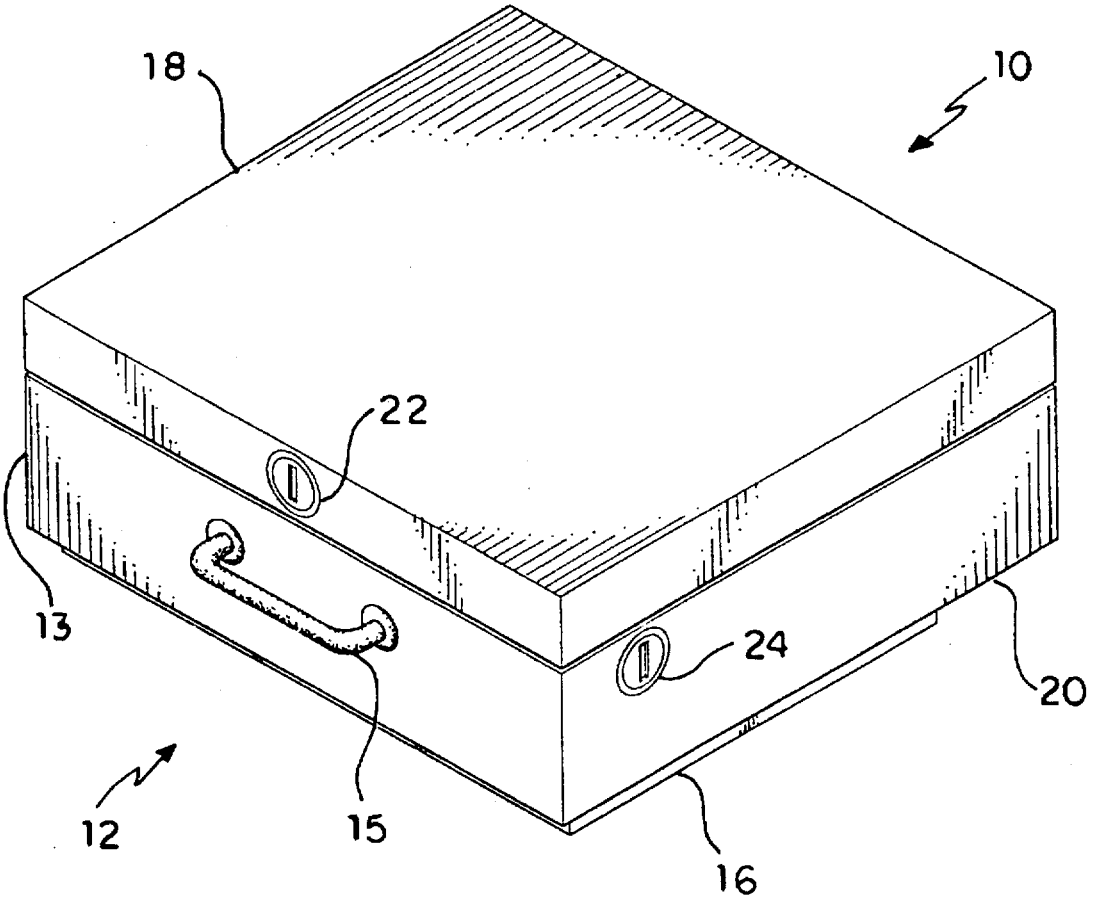
FIG. 2 is a perspective view of the invention with the case closed and the clamp raised.

FIG. 2 shows the invention with the carrying case closed and the clamp fully retracted. It can be seen that the rigid portion 16 of the clamp 12 is flush against the lower portion 20 of the carrying case 10, when the clamp is fully retracted.

Figure 3:
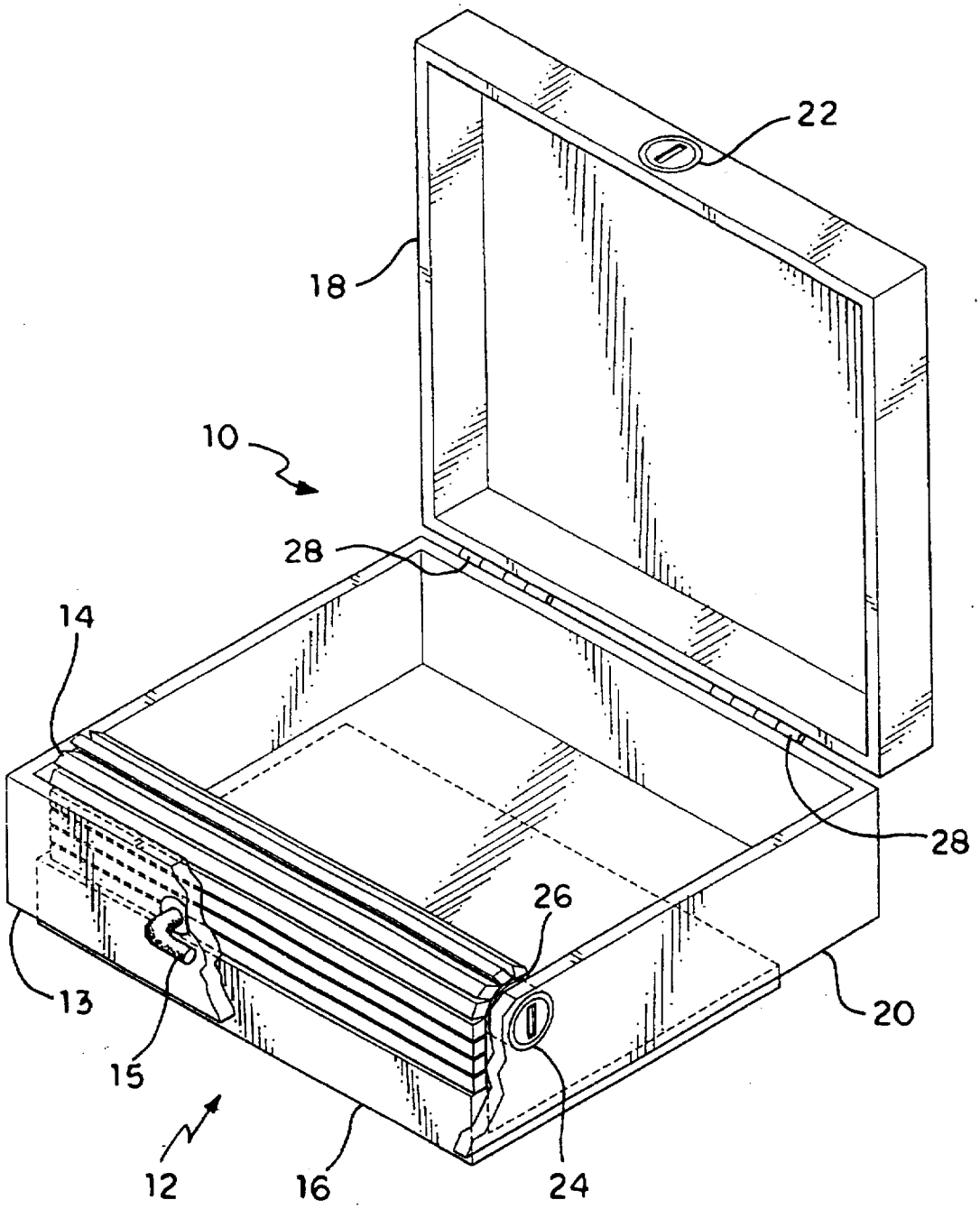
FIG. 3 is a perspective view of the invention with the case open and the clamp raised.

FIG. 3 shows the invention with the carrying case open and the clamp fully retracted. Shown in this view are the hinges 28 by which the upper and lower portions of the carrying case are pivotally connected. The flexible portion 14 of the clamp 12 is shown wound around the cylinder 26.

Figure 4:
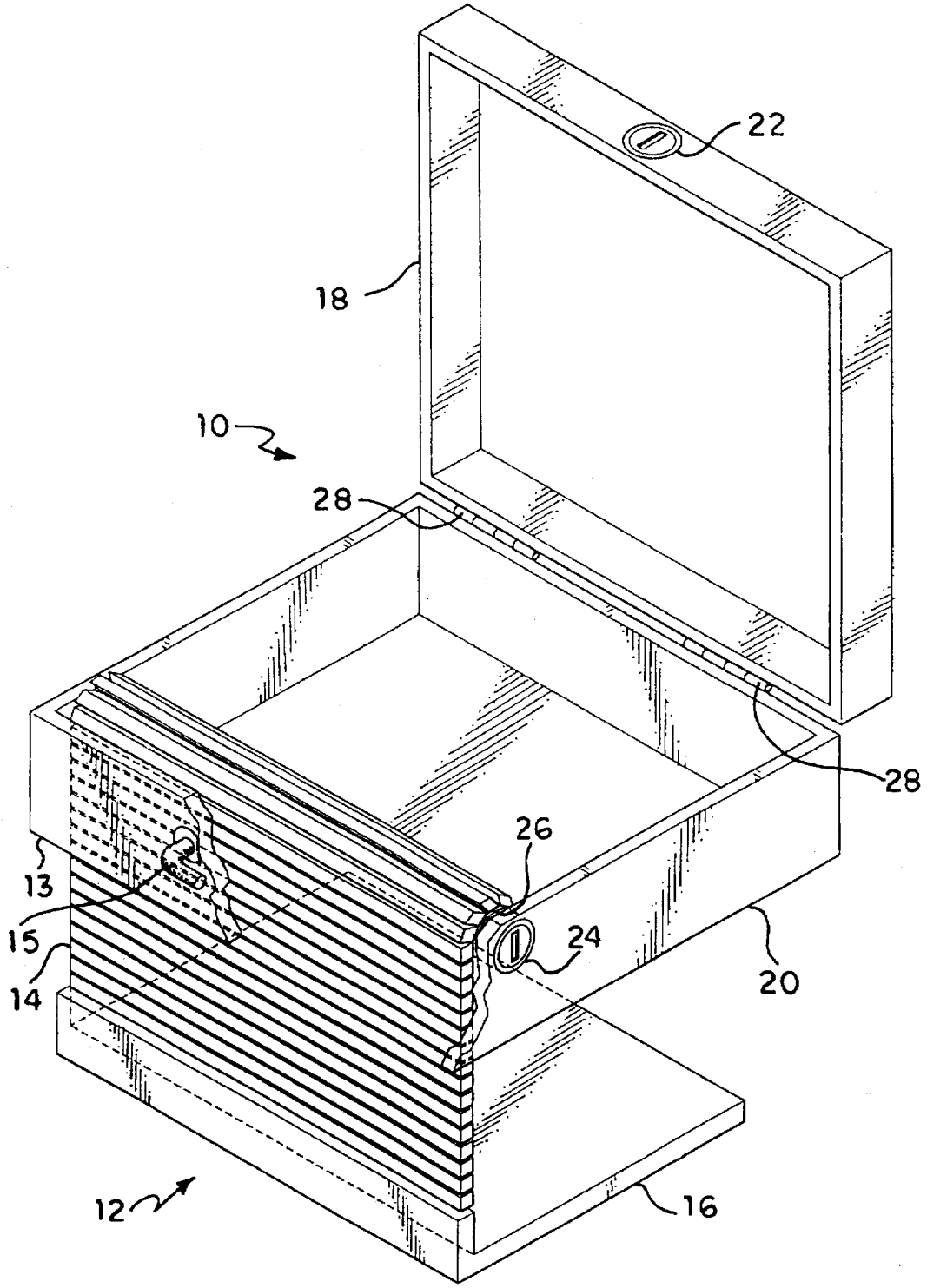
FIG. 4 is a perspective view of the invention with the case open and the clamp lowered.

FIG. 4 shows the invention with the carrying case open and the clamp fully extended. Once the clamp is extended, it and the lower portion of the carrying case can be inserted around a table or other object with similar surfaces. The clamp is then retracted to fasten the carrying case to the table or other object. The motor is strong enough to exert sufficient force so that the pressure and friction between the surfaces of the table and the invention prevents the latter from being easily removed. Preferably, the upper surface of the rigid portion of the clamp and the lower surface of the carrying case are coated with rubber similar to that used in computer mousepads, so that they will not slide easily.

The flexible portion 14 of the clamp may consist of a plurality of rigid members with flexible connections (not shown). The rigid member 16 is preferably L-shaped, to fit against the lower corner of a table top or shelf.

Additionally, there may be foam or other flexible sizing inside the carrying case to allow different sizes of computers or other equipment to be securely retained (not shown). Also, there may be doors or other openings on the lower portion of the carrying case to store cables, diskettes, or other items (not shown).

It is to be understood that the present invention is not limited to the sole embodiment described above, but encompasses any and all embodiments within the scope of the following claims.

I claim:

1. A carrying case with a theft prevention clamp, comprising:

a case having an upper portion pivotally attached to a horizontal lower portion;

a generally L-shaped clamp including a planar vertical section depending from the horizontal lower portion of said case and a planar horizontal section joined to said vertical section at a right angle;

retracting means for extending and retracting said L-shaped clamp, said retracting means disposed within said case, said retracting means configured to maneuver said L-shaped clamp between a retracted position wherein the horizontal section of said L-shaped clamp is flush with the horizontal lower portion of said case and a clamping position wherein said case is secured to an object by gripping the object between said horizontal lower portion of said case and said horizontal section of said L-shaped clamp; and locking means for securing said L-shaped clamp in the clamping position gripping the object.

2. The carrying case with a theft prevention clamp according to claim 1, including:

a lock to secure the upper and lower portions of the carrying case in a closed position.

3. The carrying case with a theft prevention clamp according to claim 1, further including a frictional material on the horizontal lower portion of said case and on said horizontal section of said clamp.

4. The carrying case with a theft prevention clamp according to claim 1, wherein the vertical section of said L-shaped clamp includes a flexible portion.

5. The carrying case with a theft prevention clamp according to claim 4, wherein said retracting means include a cylinder about which the flexible portion is wound, said cylinder having an axis perpendicular to the direction in which the flexible portion is wound.

6. The carrying case with a theft prevention clamp according to claim 1 wherein said case includes a front side and said vertical section of said clamp extends substantially along the front side of said case.

* * * * *